US005941372A

United States Patent [19]

Johnston

[11] Patent Number: 5,941,372

[45] Date of Patent: Aug. 24, 1999

[54] PUSH BUTTON SWITCHING SYSTEM AND METHOD

[75] Inventor: Mervyn Bradshaw Johnston, Easton, Md.

[73] Assignee: Dresser Industries, Inc., Dallas, Tex.

[21] Appl. No.: 09/190,998

[22] Filed: Nov. 12, 1998

[51] Int. Cl.[6] ..... H01H 13/70

[52] U.S. Cl. ..... 200/343; 200/341

[58] Field of Search ..... 200/512, 517, 200/516, 515, 339, 341, 342–345, 11 R, 16 R, 314, 315

[56] References Cited

U.S. PATENT DOCUMENTS

| | | |
|---|---|---|
| 4,350,857 | 9/1982 | Fillus et al. . |
| 4,362,910 | 12/1982 | Boebel et al. . |
| 4,365,120 | 12/1982 | Pounds . |
| 5,140,116 | 8/1992 | Schmitt-Walter . |
| 5,285,037 | 2/1994 | Baranski et al. . |
| 5,391,848 | 2/1995 | Murphy . |
| 5,588,673 | 12/1996 | Green et al. . |
| 5,607,048 | 3/1997 | Kaizu et al. . |
| 5,664,667 | 9/1997 | Kenmochi . |
| 5,743,386 | 4/1998 | Liao . |

FOREIGN PATENT DOCUMENTS

| | | | |
|---|---|---|---|
| 1163425 | 2/1964 | Germany | 200/343 |
| 2331065 | 5/1975 | Germany | 200/339 |
| WO 84/01051 | 3/1984 | Germany | 200/517 |

*Primary Examiner*—Michael L. Gellner
*Assistant Examiner*—Nhung Nguyen
*Attorney, Agent, or Firm*—Haynes and Boone, LLP

[57] ABSTRACT

A push button switch assembly and method according to which a button is mounted to a partition and has at least one hook for engaging a ledge of the partition. At least one post extends from the button and through an opening in the partition and is fastened to the partition for mounting the button to the partition for pivotal movement which is limited by the engagement of the hook with the ledge. A membrane switch is mounted on the partition, and a bumper extends from the button for engaging the membrane of the switch to activate same. The bumper is fabricated from a silicone rubber to minimize the effects of relatively large pushing forces acting on the button and to enable the assembly to be used in relatively low temperature environments.

11 Claims, 2 Drawing Sheets

PUSH BUTTON SWITCHING SYSTEM AND METHOD

BACKGROUND OF THE INVENTION

This invention relates to a push button switch assembly and method and, more particularly, to such an assembly and method according to which a membrane switch is manually actuated.

Many forms of push button switches are in the prior art, and several involve manual actuation of a membrane switch. These latter designs includes an opposing pair of flexible electrodes separated by a dielectric layer. A plurality of integral outwardly-extending protrusions are screen printed on the exterior surface of each electrode, one over each of the opposing contact portions to concentrate an applied force to bring the respective electrode contact portions together into electrical contact. This assembly will hereinafter be referred to as the "membrane", and the switch is activated, or closed, by pushing on a selected area of the membrane.

Some push button switches of the above type include an enlarged pivotal button which is manually pushed towards the membrane to activate the switch. An enlargement, or bumper, is provided on the back side of the button and is often provided with a domed, or rounded, end for engaging the membrane. In this manner, the button provides a relatively large contact area for manual engagement, while the bumper engages the relatively small, critical area of the membrane that activates the switch.

However, there are problems associated with this type of assembly. For example, the button and the associated bumper are usually fabricated integrally of hard plastic. Therefore, when a relatively large force, such as 40–50 pounds, is applied to the button, and the force is transmitted by the bumper to the membrane, it can damage the membrane.

Another problem with this type of switch occurs when the switch is located in an outdoor environment, such as a gasoline dispensing station located at a service station, and is therefore subjected to relatively low temperatures. In these environments, even if the bumper is fabricated of a soft material, such as an elastomer, to avoid the transmission of excessive forces as discussed above, this material will be subjected to a compression set at relatively low temperatures. As a result, after a few cycles of use, the bumper will not reach the membrane, or at least will not reach it with sufficient force to actuate the switch.

Therefore, what is needed is a switching assembly of the above type which does not damage the membrane when relatively high forces are applied to the button, and is operable at relatively low temperatures.

SUMMARY OF THE INVENTION

Therefore, the switch assembly of the present invention includes a button mounted to a partition and having at least one hook for engaging a ledge of the partition. The button also includes at least one post extending through an opening in the partition and fastened to the partition for mounting the button to the partition for pivotal movement which is limited by the engagement of the hook with the ledge. A membrane switch is mounted on the partition, and a bumper extends from the button for engaging the membrane of the switch to activate same.

According to the switch assembly and method of the present invention, there is no damage to the membrane when relatively high forces are applied to the button, and the switch assembly is operable at relatively low temperatures.

DETAILED DESCRIPTION OF THE PREFERRED EMBODIMENT

Figure 1:
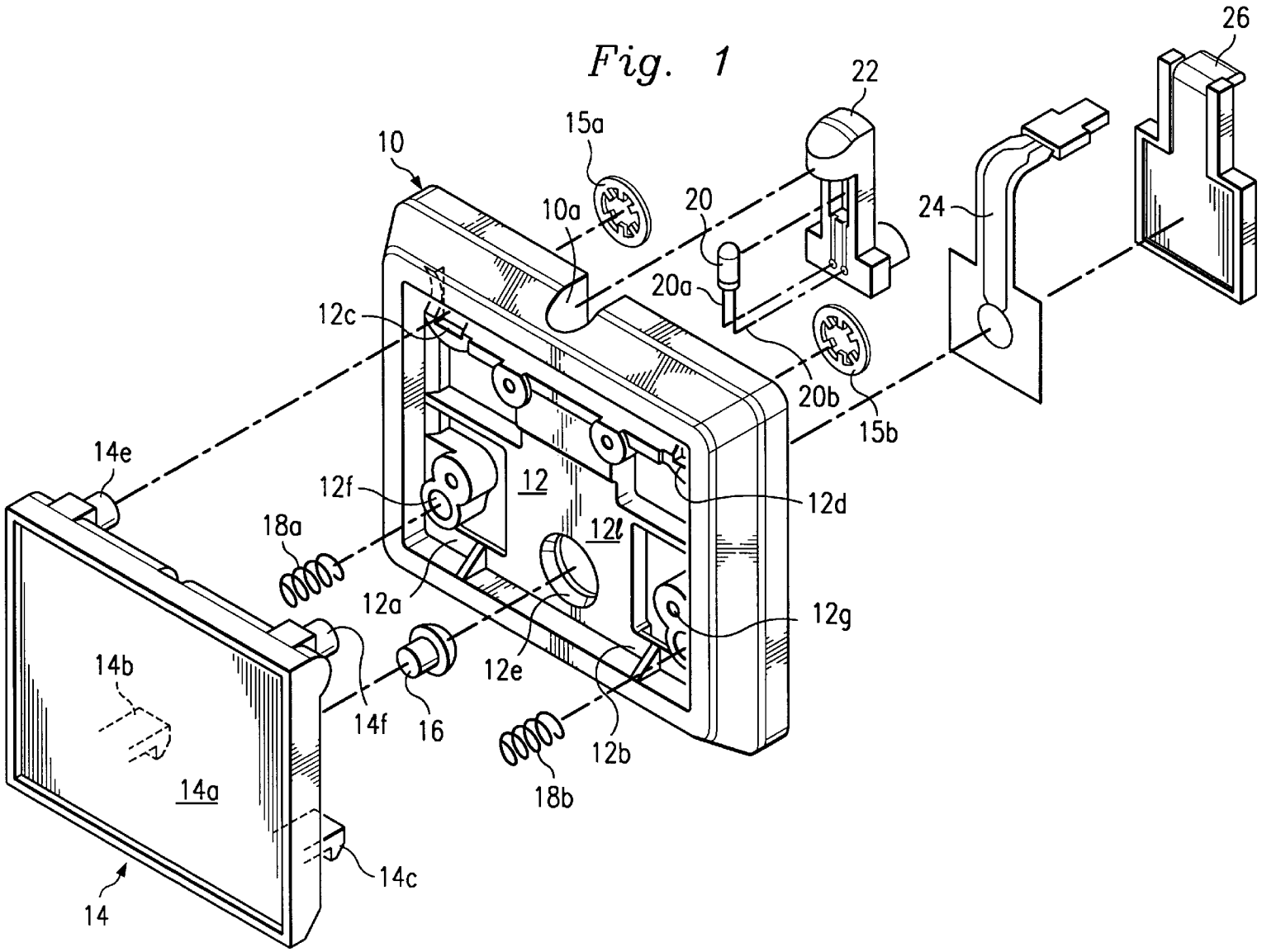
FIG. 1 is an exploded isometric view of the switch assembly of the present invention.
Figure 2:
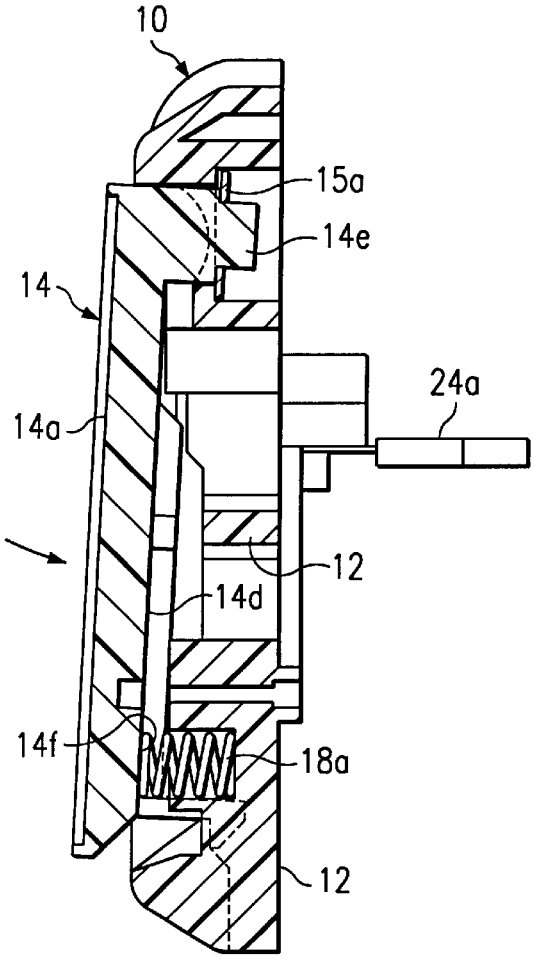
FIGS. 2 and 3 are sectional views of the switch assembly of FIG. 1 showing the components of FIG. 1 in an assembled condition.
Figure 3:
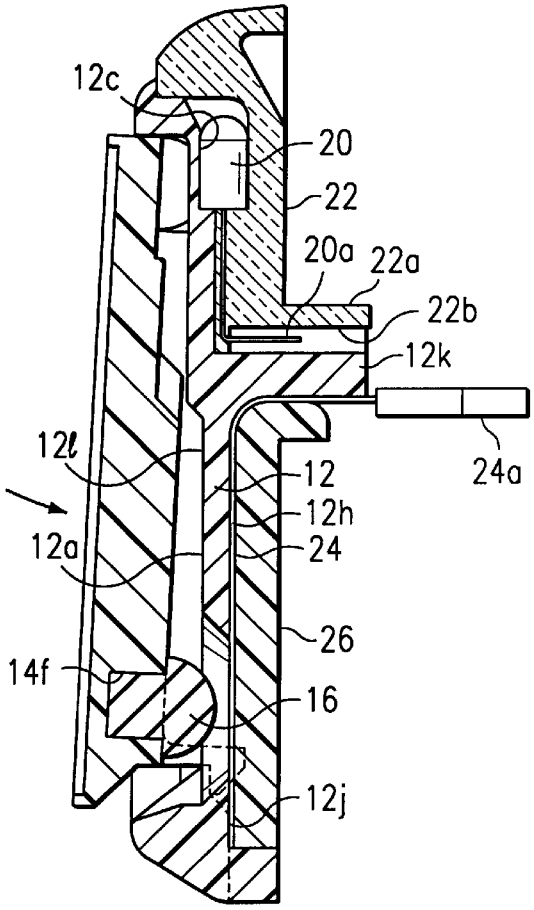

The switch assembly of the present invention is shown in FIGS. 1–3 of the drawings and includes a housing 10 having a recessed, perforated partition 12 extending therein against which a push button 14 extends. The front face 14*a* of the button 14 is solid to define a relatively large surface to be pushed when the switch is activated, The partition 12 defines two ledges 12*a* and 12*b* which respectively receive two hooks 14*b* and 14*c* extending from the back face 14*d* of the button 14.

Two posts 14*e* and 14*f* also extend from the back face 14*d* of the button 14 and through two openings 12*c* and 12*d* formed through the partition 12. A pair of fasteners, or retaining rings 15*a* and 15*b* engage the distal end portions of the posts 14*e* and 14*f*, respectively to secure the upper portion of the button 14, as viewed in the drawings, to the partition 12.

A central through opening 12*e* is provided through the partition 12 for receiving a bumper 16, and two counter bored holes 12*f* and 12*g* are provided in the partition for receiving a pair of springs 18*a* and 18*b*, respectively. An opening 14*e* (FIG. 3) is provided in the back face 14*d* of the button 14 for receiving the bumper 16.

A light emitting diode (LED) 20 (FIGS. 1 and 3) is mounted in a holder 22 which, in turn, is mounted in a slot 10*a* (FIG. 1) in the housing 10 and extending through the back face 12*h* of the partition 12. As shown in FIG. 3, the LED 20 protrudes slightly from the holder 22 and extends in a recessed slot 12*i* in the back face 12*h* of the partition 12. A membrane switch 24 is mounted to a holder 26 which is also mounted in a slot 12*j* (FIG. 3) also formed in the back face 12*h* of the partition 12 and extending just below the holder 22.

A ledge 12*k* (FIG. 3) extends from the back face of the partition 12 and receives a flange 22*a* formed on the lower end of the LED holder 22. Two electrical conductors 20*a* and 20*b* (FIG. 1) extend from the LED 20 and, as shown in FIG. 3 in connection with the conductor 20*a*, the conductors extend between the adjacent surfaces of the partition 12 and the holder 22 and are bent at a right angle so that they extend into a slot 22*b* formed in the flange 22*a* of the holder 22. This positions the conductors 20*a* and 20*b* to be connected to a "push" type electrical connector (not shown) extending from a wiring harness, or the like and adapted to push directly on to the conductors. The membrane switch 24 has a tail 24*a* that extends outwardly from the holder 26 and is also connected to the latter wiring harness.

The button 14 is mounted to the housing 10 by inserting the hooks 14*b* and 14*c* of the button 14 over the ledges 12*a* and 12*b* of the partition 12, and then extending the posts 14*e* and 14*f* through the openings 12*c* and 12*d*, respectively, of the partition. The retaining rings 15*a* and 15*b* are attached to the distal end portions of the posts 14*e* and 14*f*, respectively to secure the upper portion of the button 14 to the partition 12. As shown in FIG. 2, the springs 18*a* and 18*b* urge the lower end portion of the button 14 outwardly from the partition 12, causing a pivotal movement of the button about the secured posts 14*e* and 14*f*, with the engagement of the hooks 14*b* and 14*c* with the ledges 12*a* and 12*b*, respectively, limiting this outwardly pivotal movement to a relatively short distance.

The button 14 is activated by pushing the lower end of the button towards the partition 12 in the direction shown by the arrows in FIGS. 2 and 3 against the force of the springs 18*a* and 18*b*. This causes pivotal movement of the lower end of the button 14 towards the lower end of the partition 12 until the bumper 16 engages the membrane switch 24, and the back face 14*d* of the lower end of the button contacts the front face 121*l* of the lower end of the partition. After the springs 18*a* and 18*b* have been compressed an additional, relatively short, distance, such as 0.020 to 0.050 inches, the switch 24 is activated to close an electrical circuit (not shown) in a conventional manner, which circuit would also be connected to the above wiring harness. In addition, the activation of the switch 24 can be used to change the electrical signal to the LED 20 to provide visual indication that the circuit has been closed.

According to another feature of the present invention the bumper 16 is fabricated from a silicon rubber which compresses when it engages the membrane switch 24 and thus minimizes damage to the membrane switch 24 when relatively high pushing forces are applied to the button 14. In addition, silicon rubber is not subjected to a compression set unless the ambient temperature reaches an extremely low value, which is approximately minus 60 degrees F.

As a result, according to the switch assembly and method of the present invention, there is no damage the membrane when relatively high forces are applied to the button, and the switch assembly is operable at relatively low temperatures and is thus well-suited for outdoor use. Also, the ends of the conductors 20*a* and 20*b* of the LED can easily be engaged directly by the above-mentioned electrical connector thereby negating the requirement of a separate electrical terminal on the latter conductors.

It is understood that modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

what is claimed is:

1. A push button switch assembly comprising a partition defining at least one ledge, and at least one through opening, a button having at least one hook for engaging the ledge and at least one post extending through the opening, a fastener connected to the post to secure the button to the partition while permitting slight pivotal movement of the button relative to the partition which is limited by the engagement of the hook with the ledge, a membrane switch mounted on the partition, and a bumper extending from the button for engaging the membrane of the switch to activate same.

2. The assembly of claim 1 wherein the post and the through opening are located at one end portion of the button and the partition, respectively, and wherein the button pivots relative to the partition about the post.

3. The assembly of claim 2 where the hook and the ledge are located at the other end portion of the button and the partition, respectively, so that the other end portion of the button moves relative to the other end portion of the partition.

4. The assembly of claim 3 further comprising at least one spring extending between the button and the partition to normally urge the other end portion of the button away from the other end portion of the partition.

5. The assembly of claim 3 wherein the bumper is located on the other end portion of the button and a through opening is formed through the other end portion of the partition through which the bumper extends when the other end portion of the button is pushed towards the other end portion of the partition.

6. The assembly of claim 5 wherein the back face of the button engages the front face of the partition and wherein the switch is mounted on the back face of the partition and is engaged by the bumper after it passes through the latter through opening in the partition.

7. The assembly of claim 6 further comprising a holder for receiving the switch and a slot formed in the partition for receiving the holder.

8. The assembly of claim 6 further comprising an LED mounted on the partition for lighting when the switch is activated by the button.

9. The assembly of claim 7 further comprising a holder for receiving the LED and a slot formed in the partition for receiving the latter holder.

10. The assembly of claim 1 wherein the bumper is fabricated of a relatively soft material that engages the switch.

11. The assembly of claim 10 wherein the material is a silicone rubber.

* * * * *